US006991431B2

(12) United States Patent
Ching Wen

(10) Patent No.: US 6,991,431 B2
(45) Date of Patent: Jan. 31, 2006

(54) CEILING FAN BLADE

(76) Inventor: Winston Liu Ching Wen, No. 346, Shui Yuan Rd., Feng Yuan City, Taichung Hsien (TW)

( * ) Notice: Subject to any disclaimer, the term of this patent is extended or adjusted under 35 U.S.C. 154(b) by 48 days.

(21) Appl. No.: 10/733,438

(22) Filed: Dec. 11, 2003

(65) Prior Publication Data

US 2005/0129523 A1 Jun. 16, 2005

(51) Int. Cl.
*F04D 29/38* (2006.01)

(52) U.S. Cl. ..... 416/142; 416/242; 416/243

(58) Field of Classification Search ..... 416/5, 416/142, 143, 223 R, 228, 238, 242, 243, 416/DIG. 2

See application file for complete search history.

(56) References Cited

U.S. PATENT DOCUMENTS

| | | | | |
|---|---|---|---|---|
| 1,508,086 | A * | 9/1924 | Crawford | 416/237 |
| 4,776,761 | A * | 10/1988 | Diaz | 416/5 |
| 4,892,460 | A * | 1/1990 | Volk | 416/62 |
| 5,575,624 | A * | 11/1996 | Bogage | 416/242 |
| 6,302,652 | B1 * | 10/2001 | Roberts | 416/228 |
| 2003/0190234 | A1 * | 10/2003 | Huang | 416/228 |
| 2004/0009070 | A1 * | 1/2004 | Bird | 416/238 |

* cited by examiner

*Primary Examiner*—Edward K. Look
*Assistant Examiner*—Richard A. Edgar

(57) ABSTRACT

The present invention relates to a ceiling fan blade capable of producing full wind pressure and much wind. The solution of the present invention is to form a front and a rear wind receiving surfaces on the ceiling fan blade. A tangent angle of the rear wind-receiving surface is bigger than that of the front wind-receiving surface. A wavy wind guide surface is formed between the two wind receiving surfaces. The wavy wind guide surface and the two wind receiving surfaces can effectively increase the wind pressure and the wind; in addition, sinuous flow is substantially reduced when the blade is rotating.

3 Claims, 8 Drawing Sheets

CEILING FAN BLADE

BACKGROUND OF THE INVENTION

1. Field of the Invention

The present invention relates to a ceiling fan blade capable of producing full wind pressure and much wind. The solution of the present invention is to form a front wind receiving surface, a rear wind receiving surface and a wavy wind guide surface on the ceiling fan blade. With these structures the present invention can effectively increase the wind pressure and the wind; in addition, sinuous flow is substantially reduced when the blade is rotating.

2. Description of the Prior Arts

Conventional ceiling fan blades are normally arranged on a motor in a radial way, and the ceiling fan blades are simple plate structure, which has been used for long time, but there are still some defects need to be improved:

First, the radial arranged ceiling fan blades occupy much installation space.

Second, the radial arranged ceiling fan blade is simple plate structured, the wind that it can produce is limited.

The present invention has arisen to mitigate and/or obviate the afore-described disadvantages of the conventional ceiling fan blade.

SUMMARY OF THE INVENTION

The primary object of the present invention is to provide a ceiling fan blade capable of producing full wind pressure and much wind, on the surface of the ceiling fan blade is formed a front wind receiving surface and a rear wind receiving surface, wherein a tangent angle of the rear wind receiving surface is greater than that of the front rear wind receiving surface, the two wind receiving surfaces can effectively increase the wind pressure and produce more wind.

The secondary object of the present invention is to provide a ceiling fan blade capable of producing full wind pressure and much wind, wherein a wavy wind guide surface is formed between the two wind receiving surfaces, with this wavy wind guide surface sinuous flow can be substantially reduced when the blade is rotating.

The present invention will become more obvious from the following description when taken in connection with the accompanying drawings, which shows, for purpose of illustrations only, the preferred embodiments in accordance with the present invention.

DETAILED DESCRIPTION OF THE PREFERRED EMBODIMENTS

Figure 1:
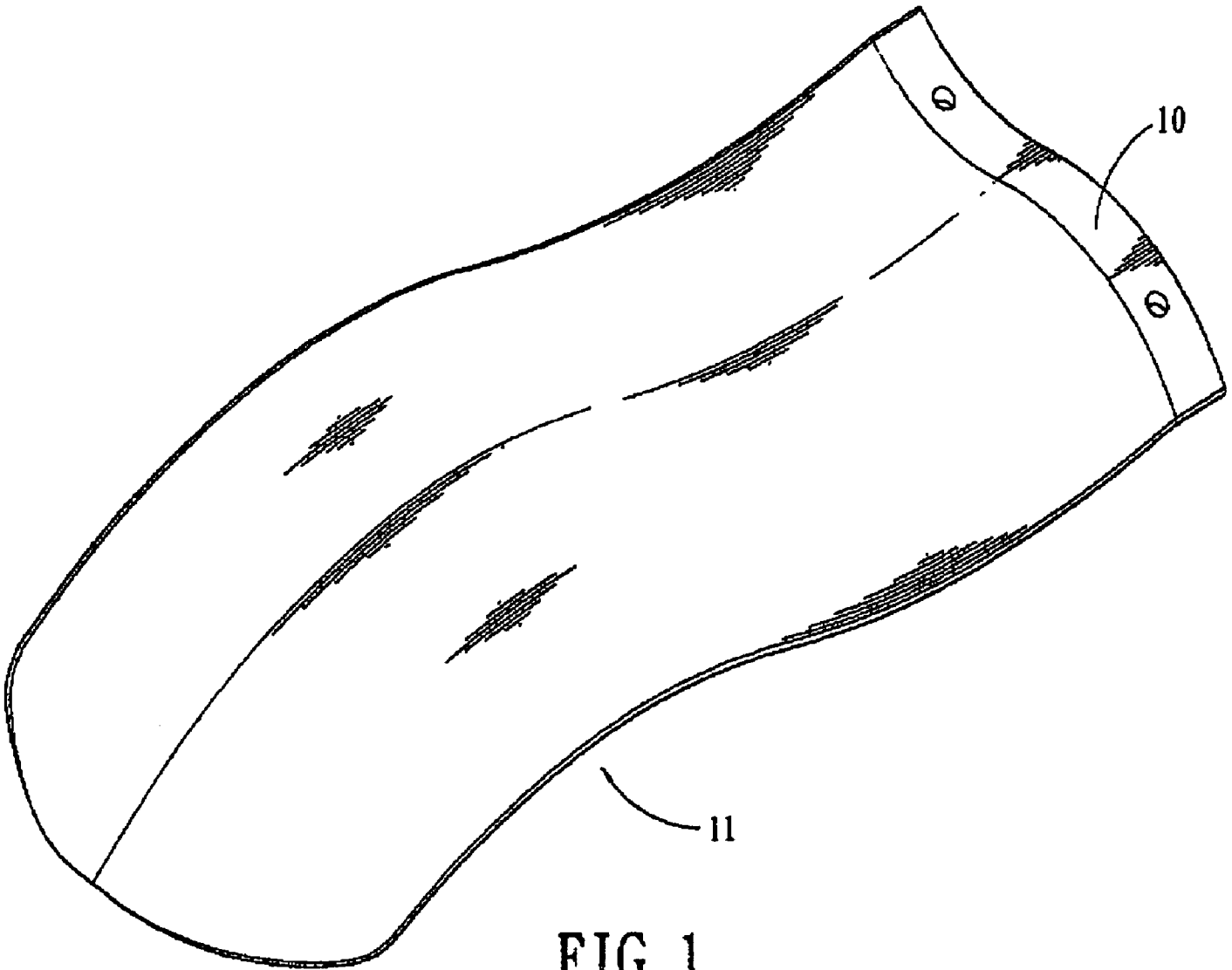
FIG. 1 is a perspective view of a ceiling fan blade in accordance with the present invention.
Figure 2:
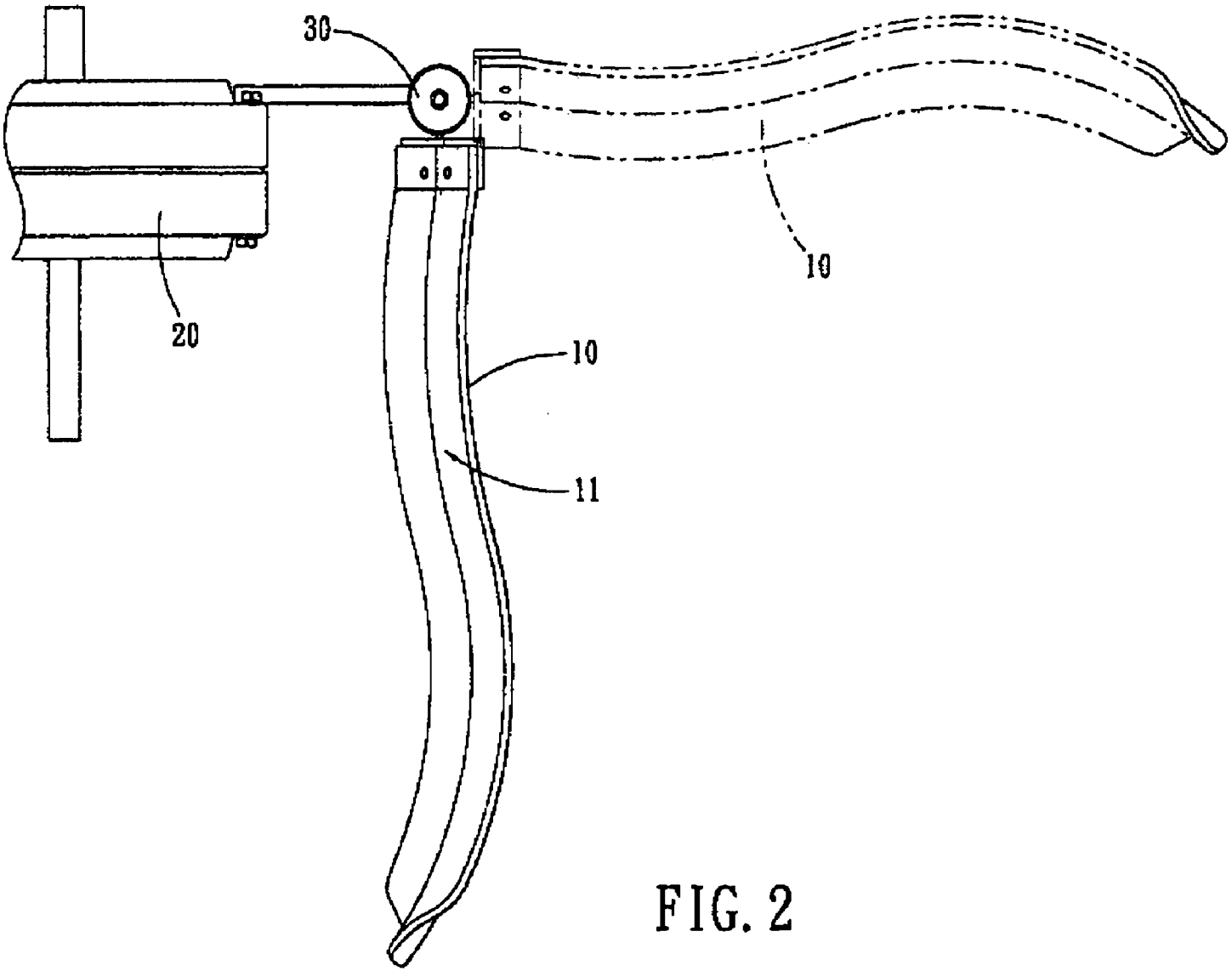
FIG. 2 is an operational view of the ceiling fan blade in accordance with the present invention.
Figure 3:
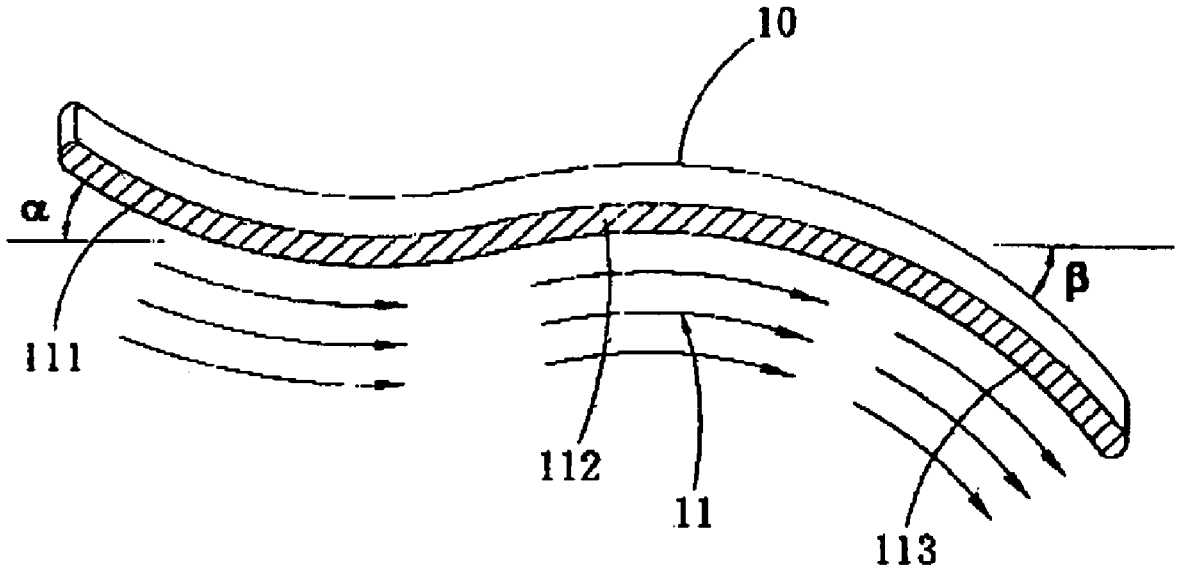
FIG. 3 is a cross sectional view of the ceiling fan blade in accordance with a first embodiment of the present invention.

Referring to FIGS. 1–3, wherein a ceiling fan blade 10 in accordance with the present invention is adapted to be mounted on a lifting mechanism 30 of a motor 20.

The ceiling fan blade 10 is defined at an upper side of a wind-receiving surface 11 which is parallel to the radial direction with an arc-shaped front wind-receiving surface 111. The front wind-receiving surface 111 forms a tangent angle $\alpha$ with respect to the horizontal line, the tangent angle $\alpha$ is same as that of normal type ceiling fan. Furthermore, next to the front wind receiving surface 111 are sequentially formed a wavy wind guide surface 112 and an arc-shaped rear wind-receiving surface 113 which forms a tangent angle $\beta$ with respect to the horizontal line. The tangent angle $\beta$ of the rear wind-receiving surface 113 is greater than the tangent angle $\alpha$ of the front wind-receiving surface 111.

Referring particularly to FIG. 2, wherein the ceiling fan blade 10 is mounted on the lifting mechanism 30 of the motor 20. When the motor 20 works, the ceiling fan blade 10 starts to rotate, the wind-receiving surface 11 begins to receive wind. The front wind-receiving surface 111 at the upside of the wind-receiving surface 11 will use the tangent angle $\alpha$ to push a part of the air downward, such that the ceiling fan blade 10 gradually moves upward around the lifting mechanism 30. Whereas the wavy wind guide surface 112 will smoothly guide the rest air that is not pushed downward by the front wind-receiving surface 111 to the rear wind-receiving surface 113, and reduce the sinuous flow to the least level. After most of the air is guided to the rear wind-receiving surface 113, and the rear wind-receiving surface 113 will produce more strong pushing force with its tangent angle $\beta$ to push the air downward, and accordingly cause a more strong reactive force. Since the tangent angle $\beta$ of the rear wind-receiving surface 113 is greater than that $\alpha$ of the front wind-receiving surface 111 (it is also greater than that of conventional ceiling fan blade), the air has been guided by the wavy wind guide surface 112 to the path that corresponds to the rear wind-receiving surface 113, and thus the rear wind-receiving surface 113 is able to produce more strong wind and wind pressure (no great resistance is generated by air). By virtue of the wavy wind guide surface 112 which is able to more stably guide the air and the gradually increased tangent angle, the ceiling fan blade is capable of producing more wind and more strong wind pressure.

Figure 4:
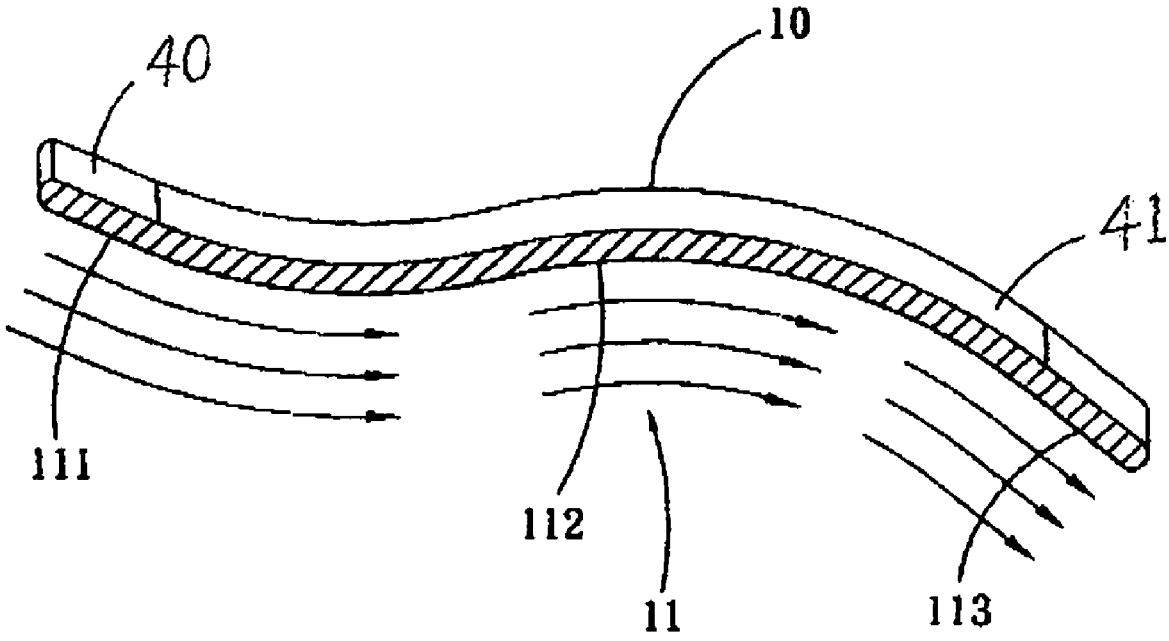
FIG. 4 is a cross sectional view of the ceiling fan blade in accordance with a second embodiment of the present invention.

Besides the above-mentioned characteristic structure, the ceiling fan blade in accordance with the present invention further has other varied structures. With reference to FIG. 4, wherein the ceiling fan blade 10 is defined at an upside of a wind-receiving surface 11 with a flat front wind-receiving surface 40, and to the wavy wind guide surface 112 is connected a flat rear wind-receiving surface 41.

Figure 5:
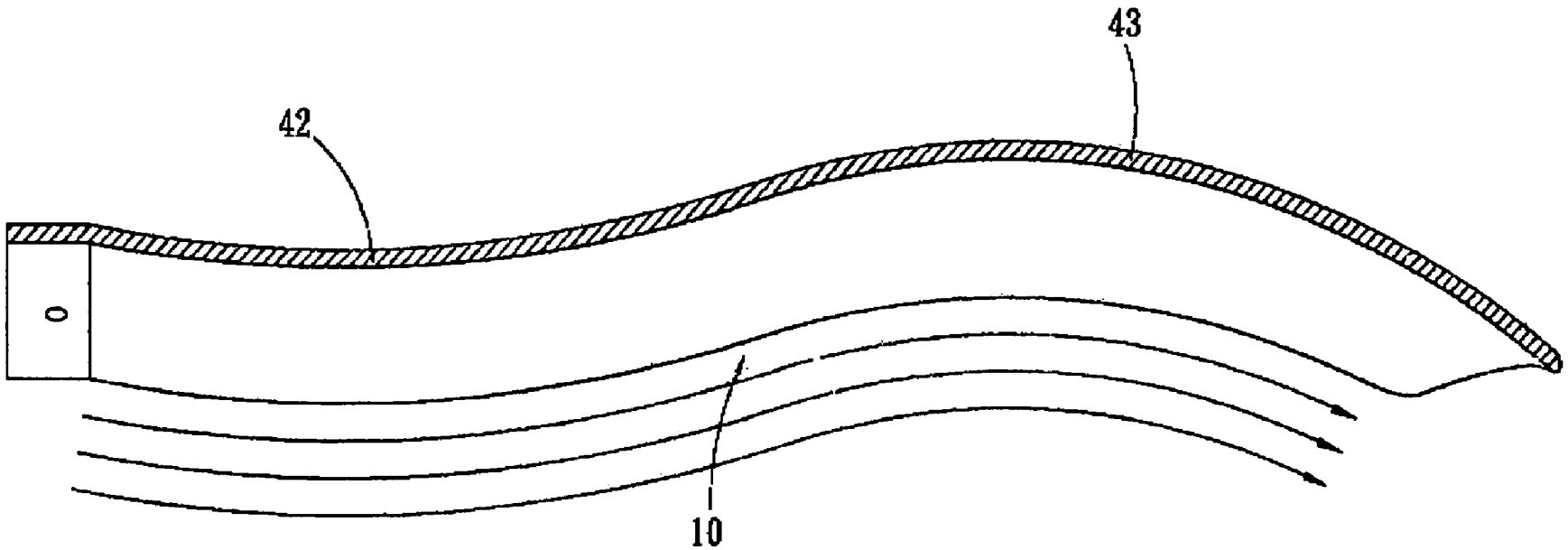
FIG. 5 is another cross sectional view of the ceiling fan blade in accordance with a first embodiment of the present invention.

It is noted that, as shown in FIG. 5, the ceiling fan blade 10 in accordance with another preferred embodiment of the present invention is formed at its inner edge with an inner arc portion 42, and at its outer edge with an outer arc portion 43. The inner arc portion 42 and the outer arc portion 43 form a wavy structure, with this wavy structure the air can be pushed outward during the rotation of the ceiling fan blade, such that, besides smoothly guiding the air to flow outward with the wavy wind guide surface 112, the ceiling fan blade of the present invention is also able to produce much more wind with the outer arc portion 43.

Figure 6:
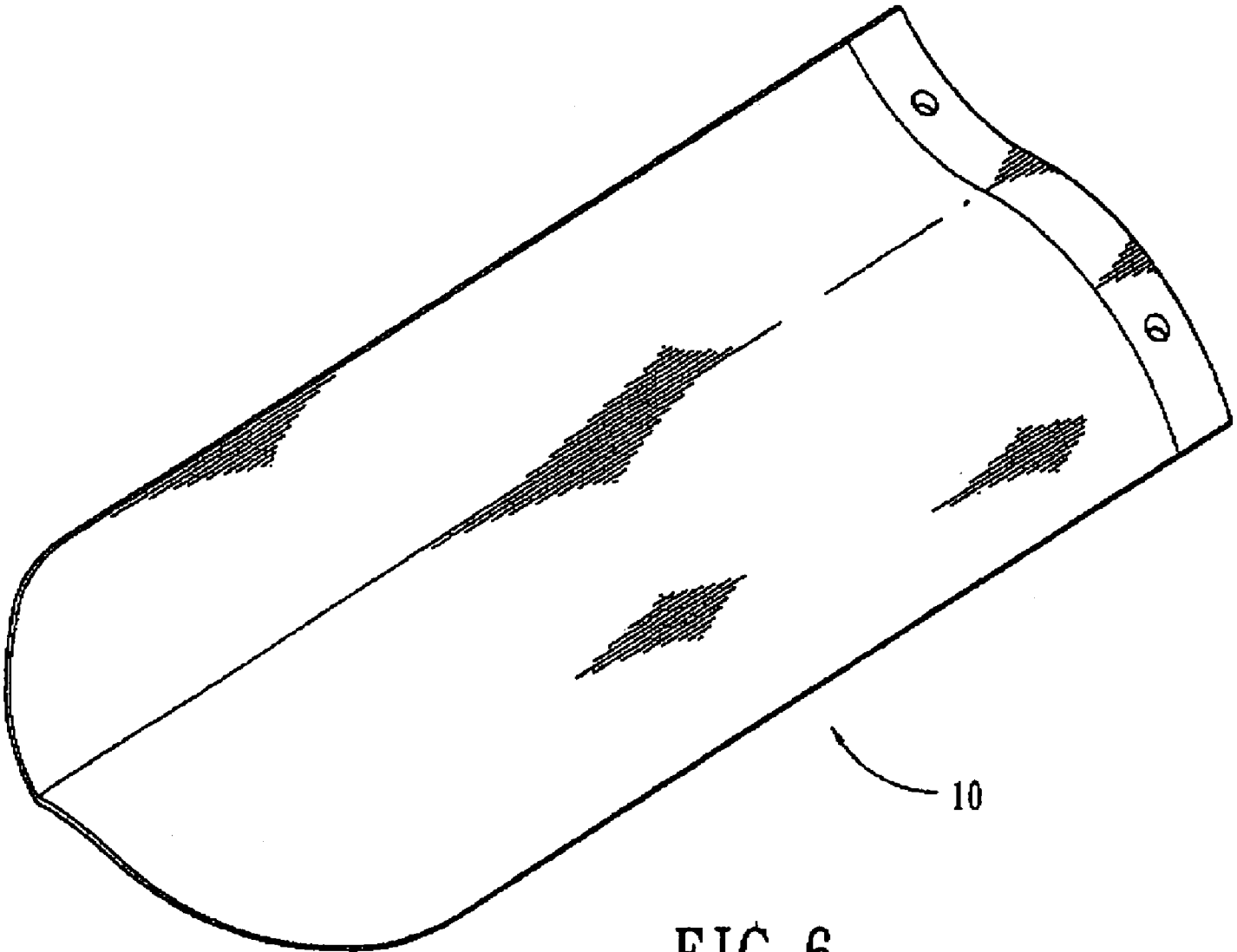
FIG. 6 is a perspective view of a ceiling fan blade in accordance with a third embodiment of the present invention.
Figure 7:
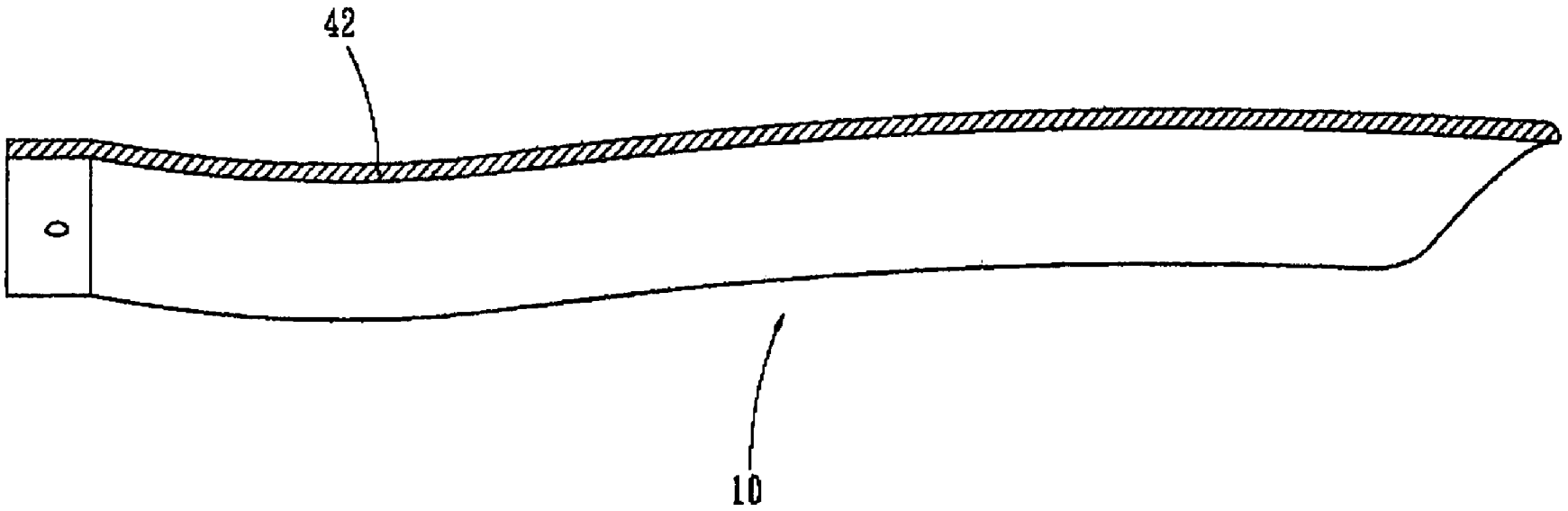
FIG. 7 is a cross sectional view of the ceiling fan blade in accordance with a fourth embodiment of the present invention.
Figure 8:
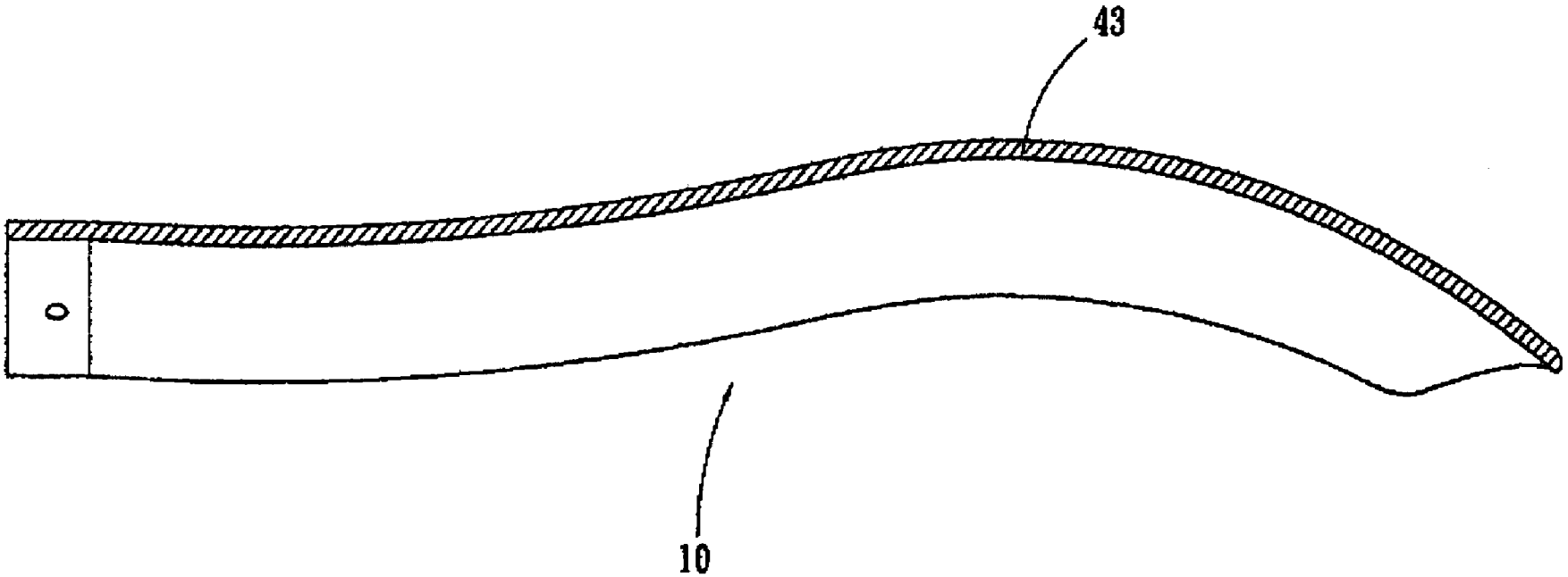
FIG. 8 is a cross sectional view of the ceiling fan blade in accordance with a fifth embodiment of the present invention.

Besides the structures of the outer and the inner arc portions 43, 42, the inner and the outer edges of the ceiling fan blade in accordance with the present invention also can be straight-formed as shown in FIG. 6. With reference to FIGS. 7 and 8, wherein the inner and the outer arc portions 42,43 also can be separately made.

Thereby in summary from above described, and FIGS. 1, 2, 3, 4, 5 and 7, in the present invention, a projection of the ceiling fan blade is formed as an oblong shape with two long sides which are approximately parallel and two short sides and any cross section of the ceiling fan blade parallel to the long sides has an S shape. Furthermore, the front wind-receiving surface, wavy wind guide surface 112, and rear wind-receiving surface 113 are arranged along the long sides. The tangent angle of the rear-wind-receiving surface 113 is greater than that of the front wind-receiving surface 111.

Furthermore, in FIGS. 1 and 6, it is illustrated that any cross section of blade parallel to the short sides has an S shape. Moreover in FIG. 2, it is illustrated that any cross section of the front wind receiving surface of the blade parallel to the short sides has a single arc shape.

While we have shown and described various embodiments in accordance with the present invention, it should be clear to those skilled in the art that further embodiments may be made without departing from the scope of the present invention.

What is claimed is:

1. A ceiling fan blade adapted to be mounted on a lifting mechanism of a ceiling fan motor; wherein the ceiling fan blade is defined at an upper side of a wind-receiving surface in parallel to a radial direction by a front wind-receiving surface which forms a tangent angle with respect to a horizontal line, next to the front wind-receiving surface is sequentially formed a wavy wind guide surface and a rear wind-receiving surface, the rear wind-receiving surface forms a tangent angle with respect to the horizontal line, the tangent angle of the rear wind-receiving surface being greater than the tangent angle of the front wind-receiving surface;

wherein the ceiling fan blade is formed as an oblong shape with two long sides which are approximately parallel and two short sides;

wherein any cross section of the ceiling fan blade parallel to the long sides has an S shape.

2. The ceiling fan blade as claimed in claim 1, wherein any cross section of blade parallel to the short sides has an S shape.

3. The ceiling fan blade as claimed in claim 1, wherein any cross section of the front wind receiving surface of the blade parallel to the short sides has a single arc shape.

* * * * *